US005752326A

United States Patent [19]

Trim

[11] Patent Number: 5,752,326

[45] Date of Patent: May 19, 1998

[54] PERSONAL DRYER

[76] Inventor: Brian Trim, 8 Northbourne Avenue, Bournemouth, Dorset, United Kingdom, BH10 6DG

[21] Appl. No.: 719,909

[22] Filed: Sep. 25, 1996

[51] Int. Cl.[6] ..... F26B 3/34

[52] U.S. Cl. ..... 34/267; 34/77; 34/219; 34/233; 34/225

[58] Field of Search ..... 34/267, 278, 565, 34/579, 582, 583, 60, 72, 73, 76, 77, 78, 102, 202, 218, 219, 233, 224, 225

[56] References Cited

U.S. PATENT DOCUMENTS

| | | | |
|---|---|---|---|
| 3,643,346 | 2/1972 | Lester | 34/202 |
| 3,667,134 | 6/1972 | Rockson | 34/60 |
| 4,369,892 | 1/1983 | Dhaemers | 34/275 |
| 4,961,271 | 10/1990 | Butler | 34/225 X |
| 5,099,587 | 3/1992 | Jarosch | 34/202 |
| 5,136,792 | 8/1992 | Janecke | 34/78 |
| 5,146,695 | 9/1992 | Yang | 34/90 |
| 5,325,604 | 7/1994 | Little | 34/565 |

FOREIGN PATENT DOCUMENTS

| | | |
|---|---|---|
| 0072994 | 3/1983 | European Pat. Off. . |
| 0176003 | 4/1986 | European Pat. Off. . |
| 494549 | 10/1938 | United Kingdom . |
| 1214307 | 12/1970 | United Kingdom . |
| 1240242 | 7/1971 | United Kingdom . |
| 1348683 | 3/1974 | United Kingdom . |
| 1453015 | 10/1976 | United Kingdom . |
| 2078510 | 1/1982 | United Kingdom . |
| 2144317 | 3/1985 | United Kingdom . |
| 2147804 | 5/1985 | United Kingdom . |
| 2178310 | 2/1987 | United Kingdom . |
| WO8001983 | 10/1980 | WIPO . |
| WO8503450 | 8/1985 | WIPO . |
| WO9107900 | 6/1991 | WIPO . |
| WO9502984 | 2/1995 | WIPO . |

*Primary Examiner*—Henry A. Bennett
*Assistant Examiner*—Steve Gravini
*Attorney, Agent, or Firm*—Richard M. Goldberg

[57] ABSTRACT

Apparatus for drying articles, particularly people, comprises a cubicle defining a drying space and one or more air impellers arranged to produce an air flow within the drying space having a swirling or vortex motion. Preferably the air is recirculated, and the recirculated air is treated, for example, heated, dried and cleaned.

25 Claims, 3 Drawing Sheets

PERSONAL DRYER

This invention relates to apparatus for drying articles, and is particularly but not exclusively concerned with drying human bodies.

The usual method of drying a body following bathing or swimming is by the use of conventional towelling. In public utilities, such as public swimming baths, hospitals, retirement and nursing homes, the dressing and changing facilities are, at the least, cramped. Further, conventional drying by towelling results in an accumulation of wet towels together with wet floors.

Similar undesirable conditions arise with normal homes where wet towels and bathroom floors are generally unavoidable.

It is already known to provide shower cubicles which are fitted with a fan unit and electric heating elements to provide a flow of warm air into the cubicle after the user has showered.

Examples of such cubicles are described and illustrated in British patents 2020970; 2222944; 2243546; 2266662 and U.S. Pat. No. 5099587.

However, all of the above units are provided with a door hinged along one side, which requires additional floor space to allow for opening of the door in order to enter the cubicle. It is also necessary to provide venting to allow for exhausting of the moisture-laiden air, and the installation of such a cubicle necessitates a plumbing operation.

It is an object of the invention to provide a drying cabinet capable of drying a human or animal body or other items which attempts to overcome the shortcomings of known systems and units and/or provides improvements generally.

In accordance with the invention there is provided a body or other drying cubicle comprising a unit having an inner wall and an outer wall defining a cavity or duct therebetween, the inner and outer walls together surrounding a drying space, at least one air impeller mounted within the cavity, air treating means within the cavity and at least one orifice in the inner wall through which heated air may pass into the interior of the unit.

The invention also provides a corresponding cubicle not limited by all features of the foregoing statement of invention but comprising a novel combination of features disclosed herein.

Preferably there are four or more impellers so arranged to cause an air flow within the drying space in a swirling or vortex motion.

Passages or ducts may be formed in the inner wall to allow the drying air to re-enter the cavity and de-humidifiers may be provided between the re-entry passages and the heaters and impellers.

In an embodiment the air is caused to impinge on the inner wall surfaces thereby creating a swirling, or vortex effect. The pressure at the periphery of the swirl of air is greater than that at the centre due to centrifugal forces, and this pressure acts on the walls of the cubicle which tends to slow down the air speed and forces the air towards the edges of the cubicle where the collector passages are preferably located. In this way the efficiency of the recirculation of air is enhanced as the cubicle acts as an enclosed return duct. A further aspect of the invention provides apparatus and a corresponding method wherein a vortex in accordance with some features mentioned above is provided.

Infra-red lamps may be mounted to direct their rays towards the drying space, and ultra-violet lamps may be incorporated within the duct in order to clean the re-circulating air germicidally.

The combination of the vortex motion of the air flow and the air re-circulation passages located at the edges of the inner wall has the advantage that the cubicle does not need to be completely enclosed. The vortex minimises the interchange of fluids within the cubicle with that of the open interfaces of the vessel. The cubicle is therefore preferably open-sided to provide a walk-through facility, or a modesty curtain may be provided at one or both ends.

Means may be provided within the cubicle for sensing the air speeds around the periphery of the vortex and signals from those sensors are used to control the fan speeds whereby a relatively stable air circulation can be achieved.

In one embodiment the base of the cubicle is provided with a pressure pad which acts to operate the main switch on entry of the user into the cubicle.

An embodiment of the invention will now be described by way of example only with reference to the accompanying drawings in which.

Figure 1:
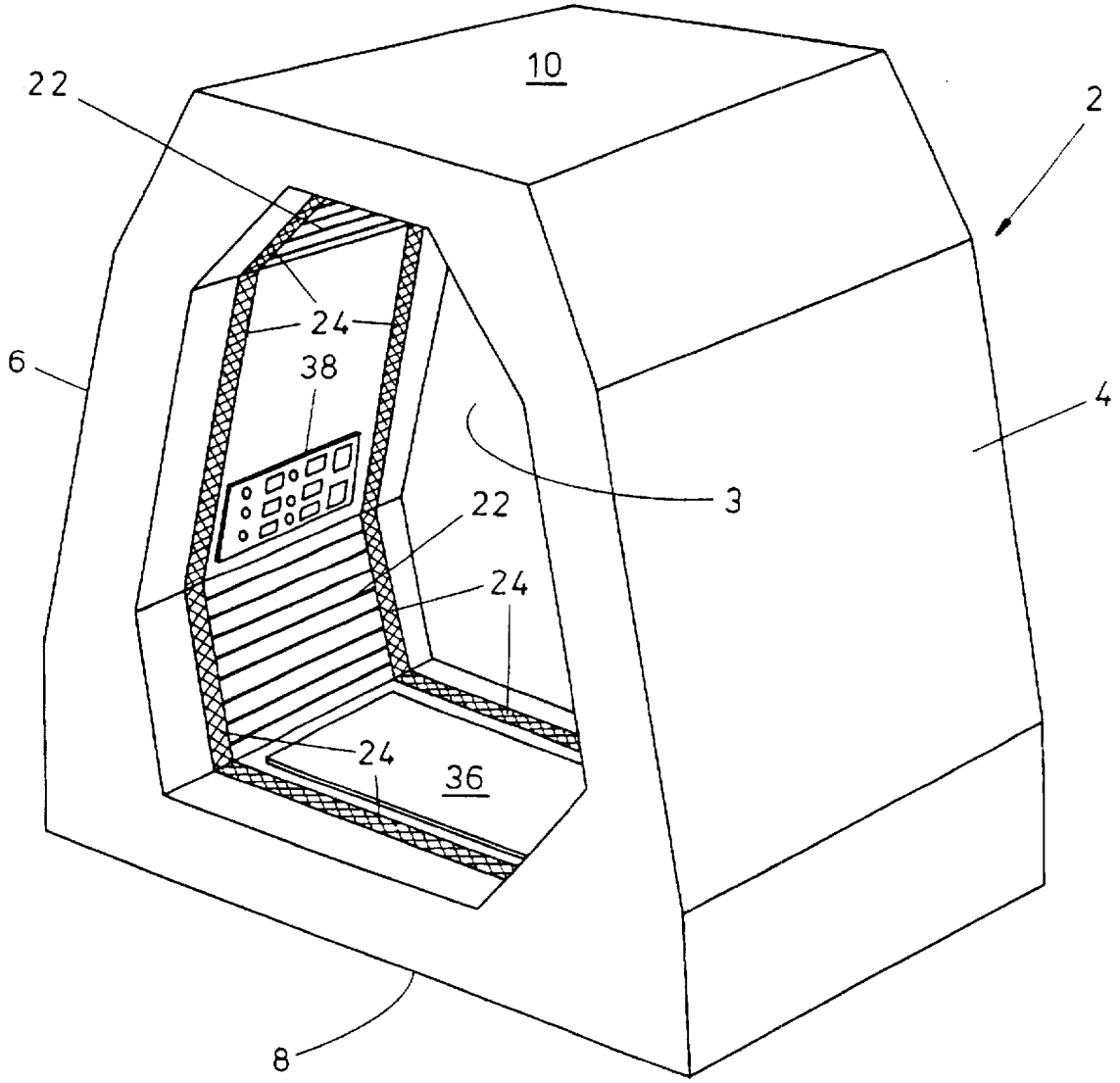
FIG. 1 is a perspective view of a drying cubicle according to the invention.
Figure 2:
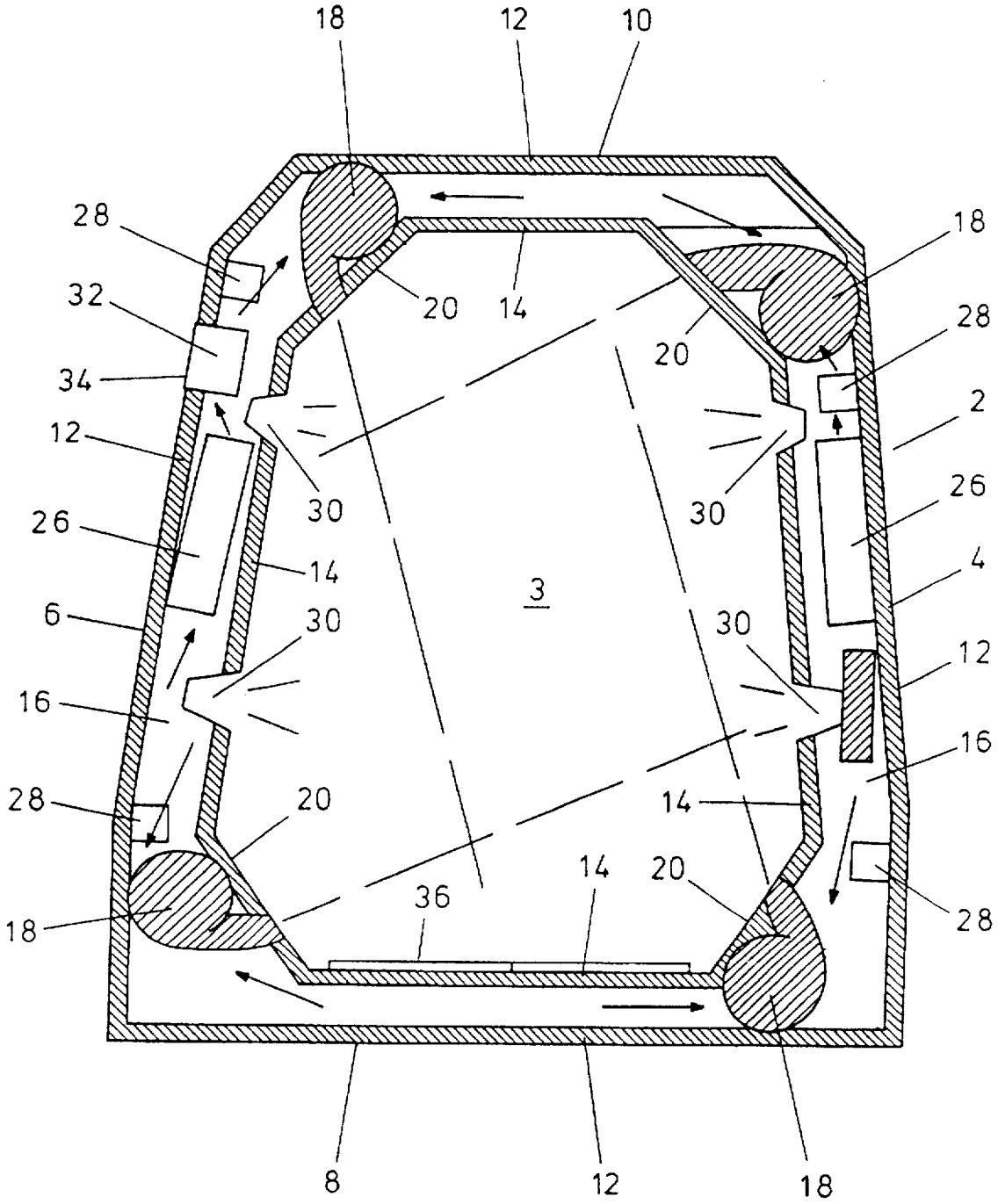
FIG. 2 is a view in section through the cubicle.

As seen in FIG. 1, a cubicle 2 according to the invention comprises a short tunnel-like construction having twin-walled sides 4, 6 a base 8 and a top portion 10. The walls 4, 6 and the base and top are formed with continuous outer skins 12 and inner skins 14 defining a continuous duct 16 therebetween. The inner skin 14 is formed with angular sections 20 which are provided with transverse grills 22 as seen clearly in FIG. 1. A drying area 3 is defined by the surrounding walls, top and base.

Figure 3:
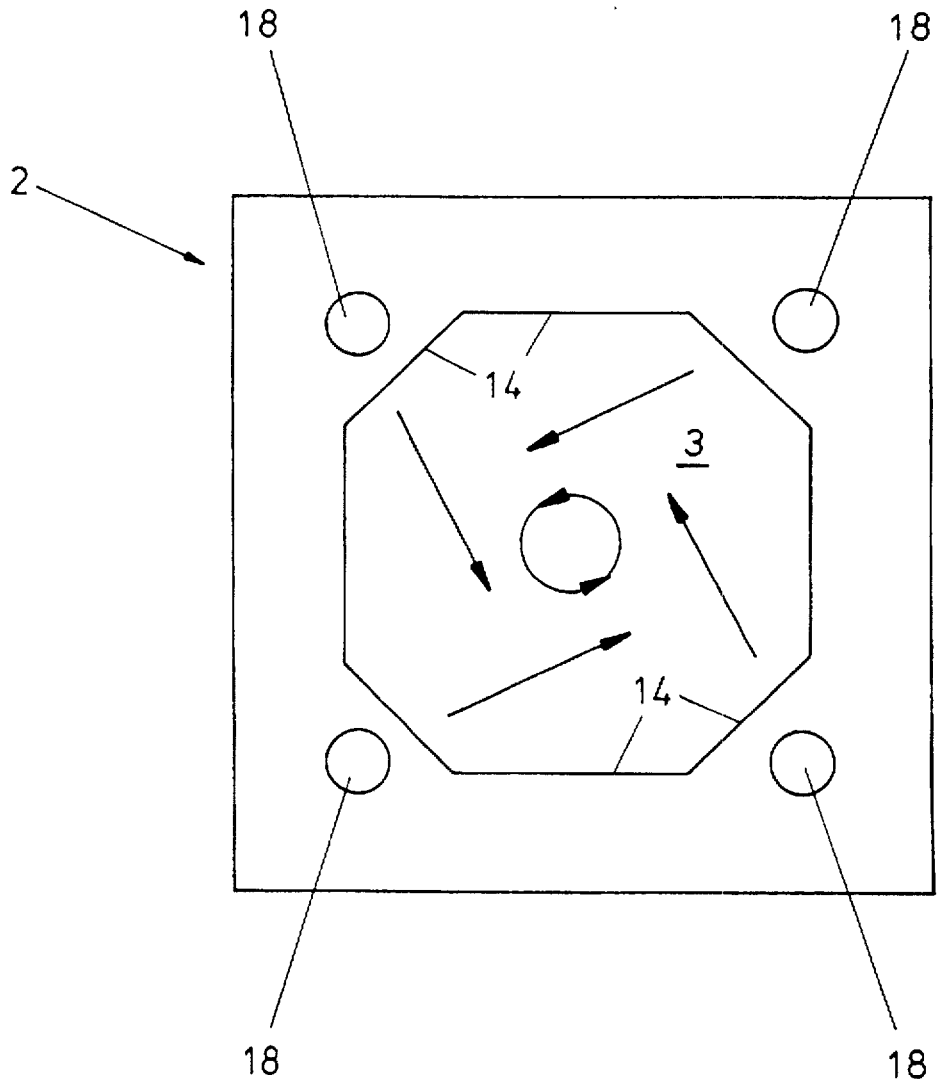
FIG. 3 is a diagrammatic view of a cubicle in use illustrating the vortex or swirling motion of the air flow.

Mounted within the duct 16 are four electrically driven fans 18 each adjacent one of the grills and so oriented to direct air into the drying area 3. The direction of flow of the air is such as to impinge at an angle on the inner surfaces of the cubicle resulting in a swirling effect in the form of a vortex as illustrated diagrammatically in FIG. 3.

The inner skins 14 of the walls 4, 6, base 8 and the top 10 are formed with bands of mesh material providing collector grills through which air may pass from the drying area into the duct 16.

As the air flow strikes the inner surface 14 it tends to flow not only in a swirl or vortex, but to pass transversely towards the outer edges of the cubicle. On reaching the collector grids 24 a proportion of the air is sucked into the duct 16 to be re-circulated.

Within the duct 16 are mounted de-humidifiers 26 to dry the moist air before it is re-circulated. These de-humidifiers may be replaced, at least in part, by air coolers or chillers, the latter being intended for use with a sauna or in a use as a cooling bath in areas of high humidity and temperature.

Also mounted within the duct 16 are heating units, 28 which may be infra-red emitters, to heat the air in the duct as it is drawn towards the inlet of the fans. Ultraviolet emitters, not shown, may be mounted within the duct 16 for direct air cleaning purposes.

Infra-red lamps 30 may be mounted on the inner skin of the duct and project therethrough to provide additional warmth of the user.

If so desired, a perfume may be incorporated in the air stream and to this end an injector unit 32 is mounted within the duct, access being available through a door 34 in the outside skin 12 as shown, or in the inside skin 14 for placement of perfume blocks as required.

In the base of the cubicle there is located a pressure pad 36 which acts to operate a main switch (not shown) to initiate or amend operation of the fans and other devices installed within the cubicle.

Mounted on an inner wall of the cubicle is a control panel 38 as shown in FIG. 1, by means of which the various facilities may be selected and adjusted, e.g. heaters, chillers, infra-red lamps, humidity and the like.

In use, a user first selects the facilities required e.g. fans, infra-red heaters, de-humidifiers, chillers, and then steps on to the pressure pad within the cubicle.

Air is then drawn through the heaters into the fans and blown into the drying area where, as described earlier, by impinging on to the inner walls of the cubicle it circulates in the form of a vortex around and in contact with the body surface of the user. As the air is constrained in the vortex by the inner walls of the cubicle a pressure is applied around the walls being in excess of the ambient pressure outside the cubicle. The air is thus squeezed transversely towards the open sides of the cubicle and is sucked into the duct 16 via the collector grids 24 for re-circulation by the fans after being dried and heated or otherwise treated as required.

By virtue of the vortex system of air flow within the cubicle and the entrapment of the air by the collector grills, there is no need for doors to enclose the space within the cubicle, although a "modesty curtain" may be provided at one or both entrances if so desired, particularly where the cubicle is installed in a public utility or e.g. a nursing home. Doors may, however, be installed when the cubicle is installed outdoors where strong wind or pressure fluctuations would upset the stable airflow of the vortex. Where the cubicle is installed in a confined space, one side may be totally enclosed.

The cubicle described above is found to be advantageous in-so-far as it eliminates the need for the use of towels for drying the body. There is not the discomfort which is often found particularly within the infirm and disabled in tortuous bending and twisting to reach all areas of the body with a towel. The consequent drying of wet towels and wet floors is also eliminated or reduced. The relaxing effect of the warm air on the muscles of the body and the option of infra-red lamp radiation directly on the skin is found to be an added advantage over conventional towelling.

A coin feed mechanism may be installed within the unit where it is provided in public utilities e.g. swimming baths and the like.

Further, a shower nozzle may be installed within the cubicle if so desired, in which case a drainage facility would be included within the base of the cubicle.

I claim:

1. A drying cubicle comprising:

a unit having an inner wall and an outer wall defining a cavity therebetween which forms at least one passageway for air flow therethrough, the inner and outer walls surrounding a drying space sufficiently large to accommodate a person therein, at least one air impeller mounted within the cavity for causing an airflow within the drying space in a swirling or vortex motion, at least one air treatment device within the cavity, at least one orifice in the inner wall through which air may pass from the cavity into the drying space, and at least one collection passage formed in the inner wall to permit air to re-enter the cavity from the drying space, for recirculation.

2. A cubicle according to claim 1 wherein the shape of a drying space in which the air is re-circulated is adapted to promote a generally circulatory motion of said air.

3. A cubicle according to claim 1 wherein the drying space in which the air is re-circulated is generally open ended and without doors.

4. A drying cubicle according to claim 1 comprising at least four impellers.

5. A drying cubicle according to claim 1 wherein said collector passages are located towards edges of the cubicle.

6. A drying cubicle according to claim 1 wherein at least one said air treatment device comprises a heater unit.

7. A drying cubicle according to claim 6 wherein at least one said heater unit comprises an infra red heater.

8. A drying cubicle according to claim 1 wherein at least one said air treatment device comprises a dehumidifier.

9. A drying cubicle according to claim 1 wherein at least one said air treatment device comprises an air cleaning device.

10. A drying cubicle according to claim 9 wherein said air cleaning device comprises at least one ultra-violet emitter.

11. A drying cubicle according to claim 1 wherein at least one air treatment device comprises an air chiller.

12. A drying cubicle according to claim 1 further comprising:

a sensor for sensing air speeds around the periphery of the vortex, and a device responsive to the sensor for controlling the speed of the at least one impeller to achieve a stable air circulation within the drying space.

13. A drying cubicle comprising:

a unit having an inner wall and an outer wall defining a cavity therebetween which forms at least one passageway for air flow therethrough, the inner and outer walls surrounding a drying space sufficiently large to accommodate a person therein, and the drying space is open at at least one edge thereof and without doors covering an opening thereat, a plurality of orifices in the inner wall through which air may pass from the cavity into the drying space, a plurality of air impellers within the cavity for causing an airflow within the drying space in a swirling or vortex motion, at least one collection passage in the inner wall to permit air to re-enter the cavity from the drying space, for recirculation, each said collection passage being arranged adjacent one edge of the drying space to prevent air from escaping outside of said drying cubicle from said drying space, and a plurality of air treatment devices spaced apart within the cavity for treating the air in the cavity.

14. A drying cubicle according to claim 13 wherein said plurality of air treatment devices is selected from the group consisting of a heater unit, a dehumidifier, an air cleaning device, and an air chiller.

15. A drying cubicle according to claim 13 further comprising:

a sensor for sensing air speeds around the periphery of the vortex, and a device responsive to the sensor for controlling the speed of the at least one impeller to achieve a stable air circulation within the drying space.

16. A drying cubicle according to claim 13 wherein the plurality of air impellers are spaced apart within the cavity for directing air from the cavity and through the orifices into the drying space so as to impinge upon the inner wall at an angle thereto, causing an airflow within the drying space in a swirling or vortex motion to promote a generally circulatory motion of said air in said drying space.

17. A drying cubicle according to claim 13 wherein the drying space is open at opposite edges thereof and without doors covering openings thereat, and there are at least two said collection passages in the inner wall to permit air to re-enter the cavity from the drying space, for recirculation, said collection passages being arranged adjacent opposite edges of the drying space to prevent air from escaping outside of said drying cubicle from said drying space.

18. A drying cubicle comprising:

a unit having an inner wall and an outer wall defining a cavity therebetween which forms at least one passageway for air flow therethrough, the inner and outer walls surrounding a drying space sufficiently large to accommodate a person therein, a plurality of orifices in the inner wall through which air may pass from the cavity into the drying space, and a plurality of air impellers spaced apart within the cavity for directing air from the cavity and through the orifices into the drying space so as to impinge upon the inner wall at an angle thereto, causing an airflow within the drying space in a swirling or vortex motion to promote a generally circulatory motion of said air in said drying space, at least one collection passage in the inner wall to permit air to re-enter the cavity from the drying space, for recirculation, and a plurality of air treatment devices spaced apart within the cavity for treating the air in the cavity.

19. A drying cubicle according to claim 18 wherein said plurality of air treatment devices is selected from the group consisting of a heater unit, a dehumidifier, an air cleaning device, and an air chiller.

20. A drying cubicle according to claim 18 further comprising:

a sensor for sensing air speeds around the periphery of the vortex, and a device responsive to the sensor for controlling the speed of the at least one impeller to achieve a stable air circulation within the drying space.

21. A drying cubicle comprising:

a unit having a top wall, a bottom wall, an inner side wall and an outer side wall, with a cavity defined between said inner side wall and said outer side wall which forms at least one passageway for air flow therethrough, the top wall, bottom wall and inner and outer side walls surrounding a drying space sufficiently large to accommodate a person therein, at least one air impeller mounted within the cavity for causing an airflow within the drying space in a swirling or vortex motion, at least one air treatment device within the cavity, at least one orifice in the inner wall through which air may pass from the cavity into the drying space, and at least one collection passage formed in the inner wall to permit air to re-enter the cavity from the drying space, for recirculation.

22. A drying cubicle according to claim 21 wherein said at least one said air treatment device is selected from the group consisting of a heater unit, a dehumidifier, an air cleaning device, and an air chiller.

23. A drying cubicle according to claim 21 further comprising:

a sensor for sensing air speeds around the periphery of the vortex, and a device responsive to the sensor for controlling the speed of the at least one impeller to achieve a stable air circulation within the drying space.

24. A drying cubicle according to claim 21 wherein there are a plurality of said air impellers spaced apart within the cavity for directing air from the cavity and through the orifices into the drying space so as to impinge upon the inner wall at an angle thereto, causing an airflow within the drying space in said swirling or vortex motion to promote a generally circulatory motion of said air in said drying space.

25. A drying cubicle according to claim 21 wherein the drying space is open at opposite edges thereof and without doors covering openings thereat, and there are at least two said collection passages in the inner wall to permit air to re-enter the cavity from the drying space, for recirculation, said collection passages being arranged adjacent opposite edges of the drying space to prevent air from escaping outside of said drying cubicle from said drying space.

* * * * *